US011825891B1

(12) United States Patent
Wilson

(10) Patent No.: US 11,825,891 B1
(45) Date of Patent: Nov. 28, 2023

(54) GLOVES WITH FINGER-WARMING INSERT POCKETS

(71) Applicant: Robert Dean Wilson, Grove City, OH (US)

(72) Inventor: Robert Dean Wilson, Grove City, OH (US)

( * ) Notice: Subject to any disclaimer, the term of this patent is extended or adjusted under 35 U.S.C. 154(b) by 219 days.

(21) Appl. No.: 17/474,194

(22) Filed: Sep. 14, 2021

(51) Int. Cl.
*A41D 19/00* (2006.01)
*A41D 13/005* (2006.01)

(52) U.S. Cl.
CPC ..... *A41D 19/002* (2013.01); *A41D 13/0058* (2013.01)

(58) Field of Classification Search
CPC ..... A41D 19/01535; A41D 19/002; A41D 13/0058; A41D 13/0051; A41D 19/0006; A41D 19/01594; A41D 19/01541; A41D 19/01529; A61F 7/032; A61F 7/034; A61F 2007/036; A61F 2007/038; A61F 2007/0233; A61F 7/03; A61F 2007/0036; A61F 2007/0037; A61F 2007/0038; A61F 2007/0238; A61F 2007/0268
See application file for complete search history.

(56) References Cited

U.S. PATENT DOCUMENTS 4,535,482 A 8/1985 Spector
5,187,814 A 2/1993 Gold
5,617,583 A 4/1997 Yates
7,043,768 B2 5/2006 Gogarty
D595,458 S 6/2009 Kleinert
9,295,580 B1 3/2016 Deola
9,671,134 B2 * 6/2017 Saita ..... F24V 30/00
2001/0023366 A1 * 9/2001 Usui ..... A43B 7/02 607/111
2007/0267583 A1 * 11/2007 Dodo ..... C09K 5/18 250/493.1
2008/0206549 A1 * 8/2008 Dodo ..... F24V 30/00 428/320.2
2008/0251062 A1 * 10/2008 Dodo ..... C09K 5/18 156/60
2008/0269850 A1 * 10/2008 Dodo ..... F24V 30/00 607/96
2010/0095947 A1 * 4/2010 Gellis ..... A41D 19/01535 126/263.01
2011/0041229 A1 * 2/2011 Niemi ..... A41D 19/01535 607/108

(Continued)

FOREIGN PATENT DOCUMENTS

FR 3075004 A1 * 6/2019
KR 20100003769 U * 4/2010

(Continued)

*Primary Examiner* — Amy Vanatta
(74) *Attorney, Agent, or Firm* — Kyle A. Fletcher, Esq.

(57) ABSTRACT

The gloves with finger-warming insert pockets comprise a pair of gloves, a plurality of heating strip pockets, and a plurality of heating strips. The pair of gloves may be adapted to be donned by a user. The gloves with finger-warming insert pockets may be adapted to warm a user's hands. The plurality of heating strips may be activated to produce heat and may be placed into the plurality of heating strip pockets located on the dorsal side of a plurality of finger stalls on both a left glove and a right glove. The plurality of heating strips may be removed from the plurality of heating strip pockets when spent.

18 Claims, 5 Drawing Sheets

(56) References Cited

U.S. PATENT DOCUMENTS

| | | | | |
|---|---|---|---|---|
| 2014/0230127 | A1* | 8/2014 | Cruz | F24V 30/00 2/160 |
| 2015/0157065 | A1* | 6/2015 | Pierias | A41B 11/005 126/204 |
| 2016/0252272 | A1 | 9/2016 | Riddick, Sr. | |
| 2017/0172234 | A1* | 6/2017 | Cox | F24V 30/00 |
| 2019/0059478 | A1* | 2/2019 | Walker | A41D 19/01535 |
| 2021/0274867 | A1* | 9/2021 | Shaikh | A41D 19/01535 |

FOREIGN PATENT DOCUMENTS

| | | | | |
|---|---|---|---|---|
| KR | 20140108094 | A | * | 9/2014 |
| KR | 20140124174 | A | * | 10/2014 |
| KR | 102153097 | B1 | * | 9/2020 |
| KR | 102164069 | B1 | * | 10/2020 |
| WO | 1996020619 | | | 7/1996 |

* cited by examiner

GLOVES WITH FINGER-WARMING INSERT POCKETS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of hand coverings and personal safety equipment, more specifically, gloves with finger-warming insert pockets.

SUMMARY OF INVENTION

The gloves with finger-warming insert pockets comprise a pair of gloves, a plurality of heating strip pockets, and a plurality of heating strips. The pair of gloves may be adapted to be donned by a user. The gloves with finger-warming insert pockets may be adapted to warm a user's hands. The plurality of heating strips may be activated to produce heat and may be placed into the plurality of heating strip pockets located on the dorsal side of a plurality of finger stalls on both a left glove and a right glove. The plurality of heating strips may be removed from the plurality of heating strip pockets when spent.

An object of the invention is to provide a pair of gloves for covering the user's hands.

Another object of the invention is to provide a plurality of heating strip pockets on the dorsal side of finger stalls of the gloves for holding a plurality of heating strips.

A further object of the invention is to provide a plurality of heating strips that produce heat when activated by exposure to air.

Yet another object of the invention is to provide a specific layering of fabrics within the gloves to enhance comfort, durability, and to retain heat.

These together with additional objects, features and advantages of the gloves with finger-warming insert pockets will be readily apparent to those of ordinary skill in the art upon reading the following detailed description of the presently preferred, but nonetheless illustrative, embodiments when taken in conjunction with the accompanying drawings.

In this respect, before explaining the current embodiments of the gloves with finger-warming insert pockets in detail, it is to be understood that the gloves with finger-warming insert pockets is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gloves with finger-warming insert pockets.

It is therefore important that the claims be regarded as including such equivalent construction insofar as they do not depart from the spirit and scope of the gloves with finger-warming insert pockets. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
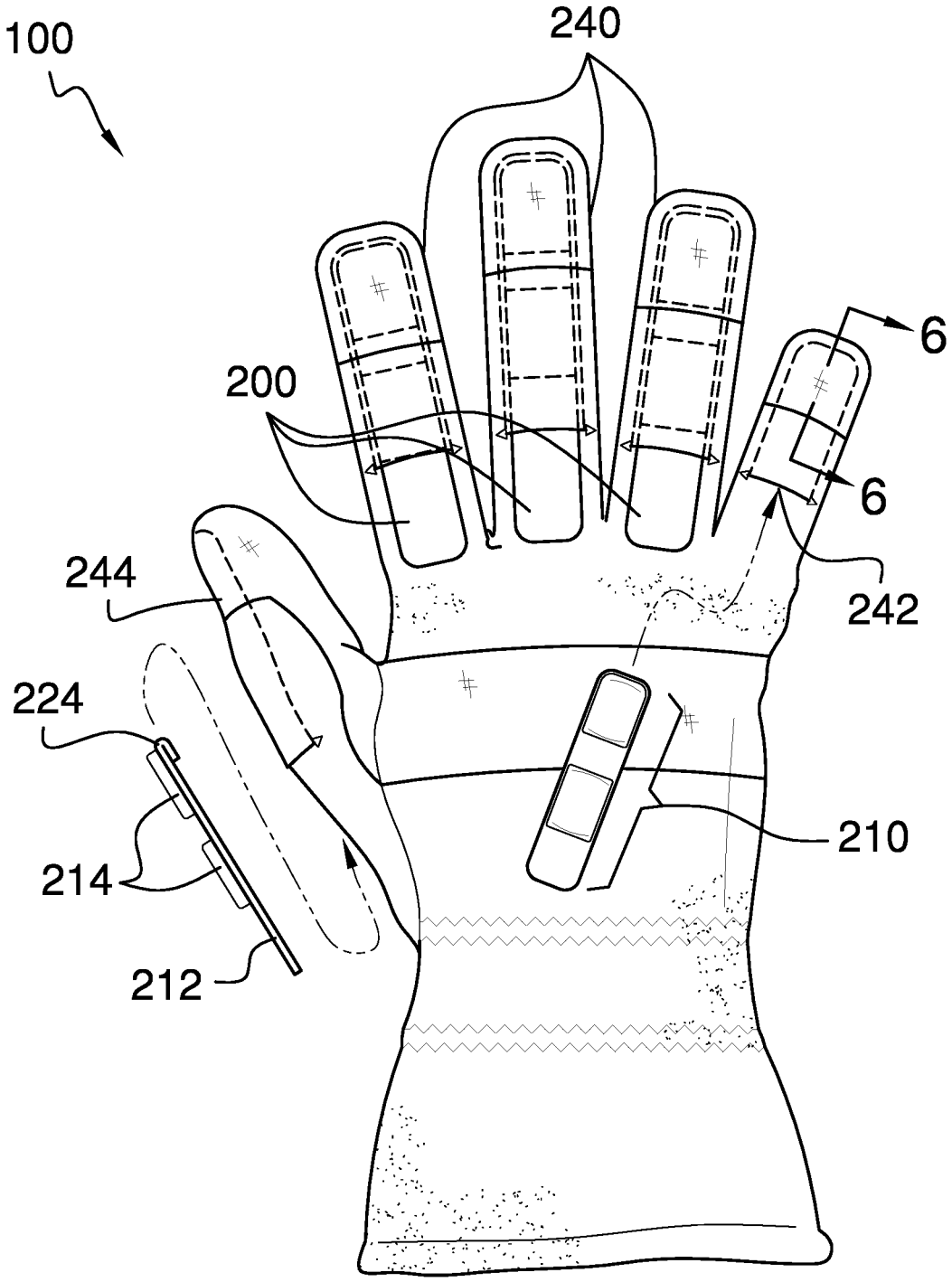
FIG. 1 is a dorsal side view of an embodiment of the disclosure.
Figure 2:
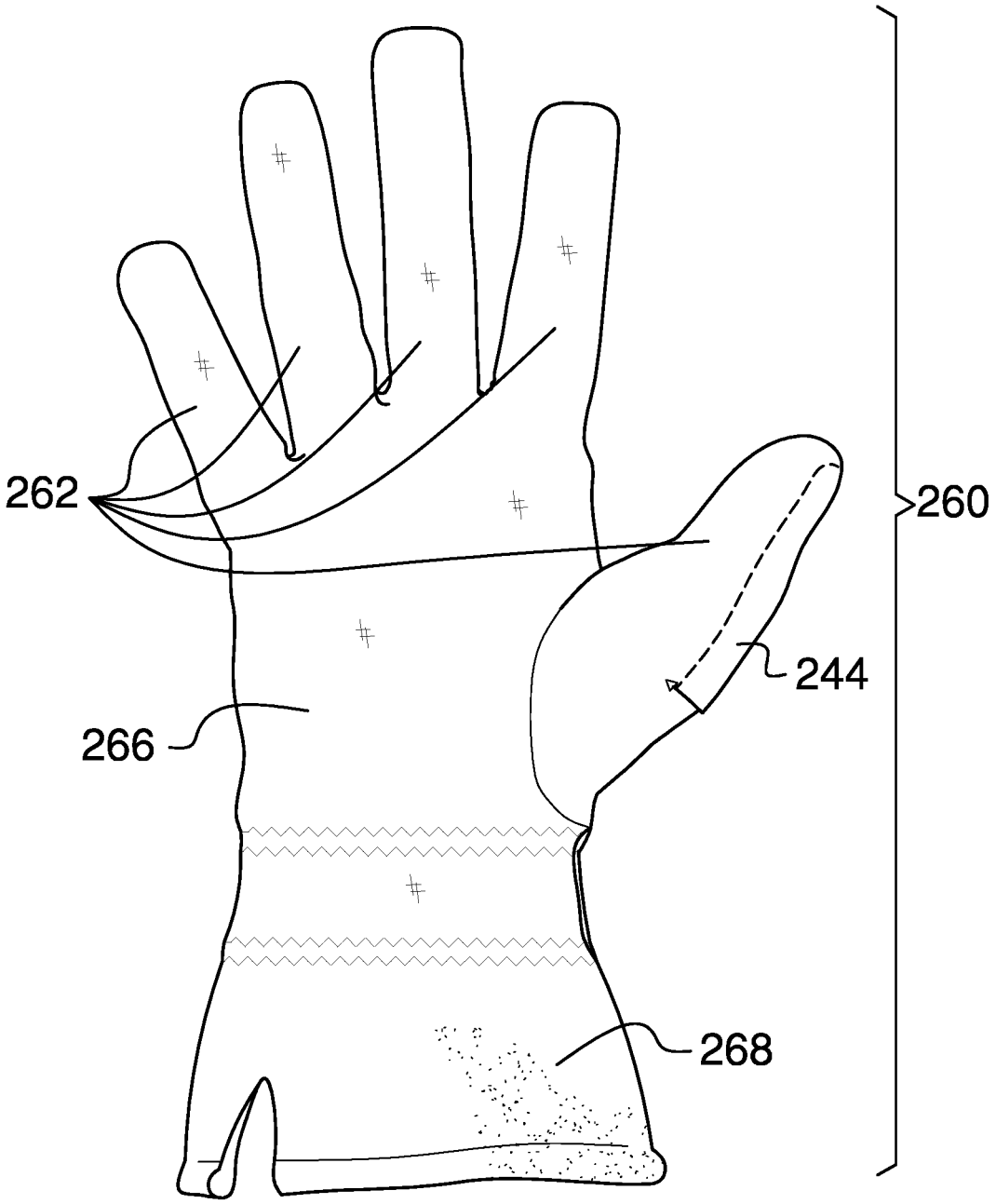
FIG. 2 is a palmer side view of an embodiment of the disclosure.
Figure 3:
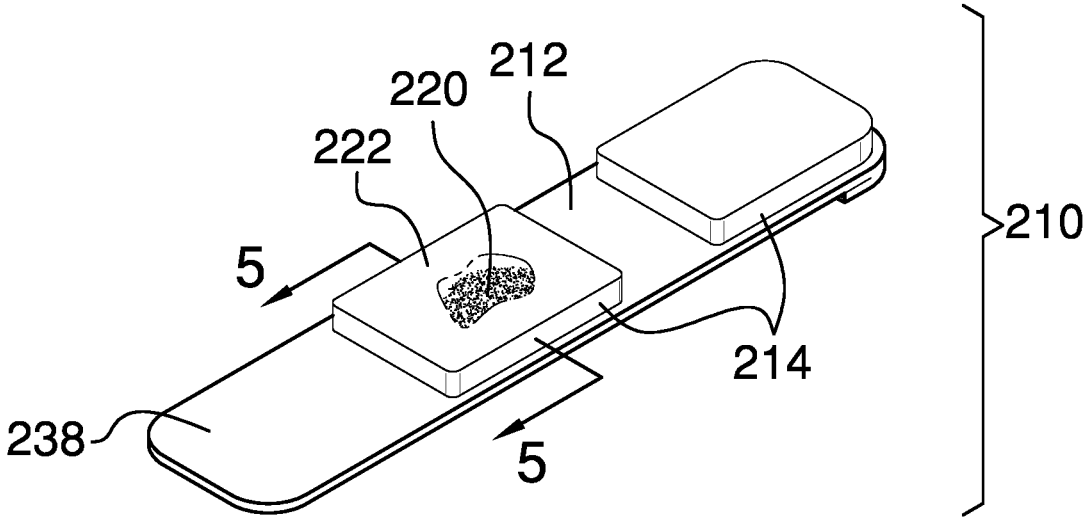
FIG. 3 is a top isometric view of an embodiment of the disclosure illustrating details of an individual heating strip.
Figure 4:
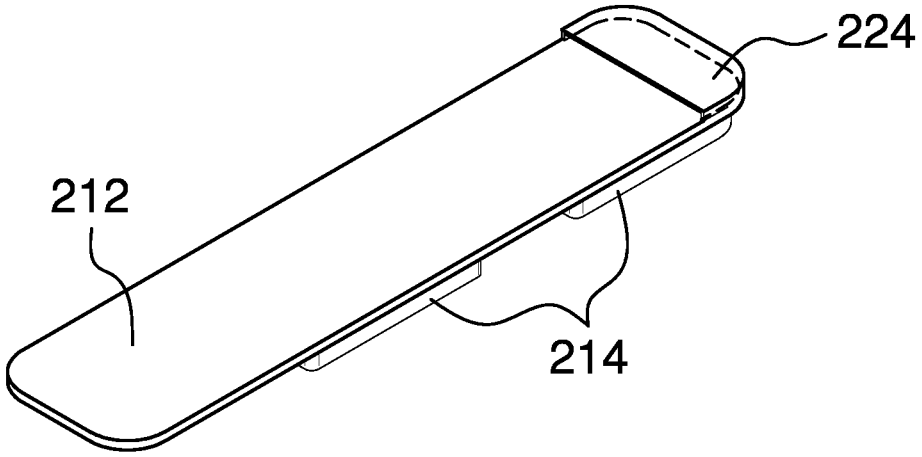
FIG. 4 is a bottom isometric view of an embodiment of the disclosure illustrating details of an individual heating strip.
Figure 5:
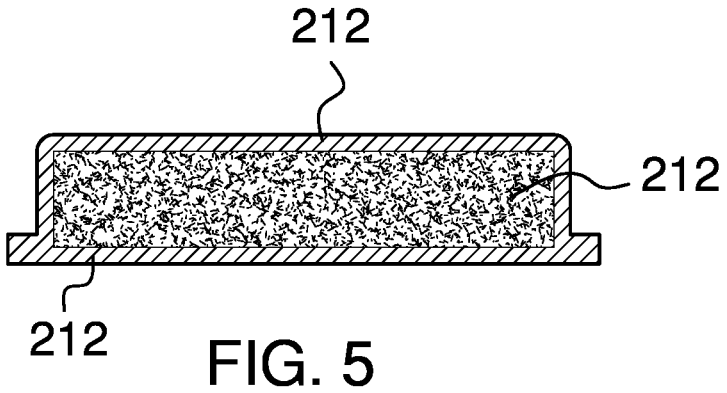
FIG. 5 is a cross-sectional view of an embodiment of the disclosure across 5-5 as shown in FIG. 3.
Figure 6:
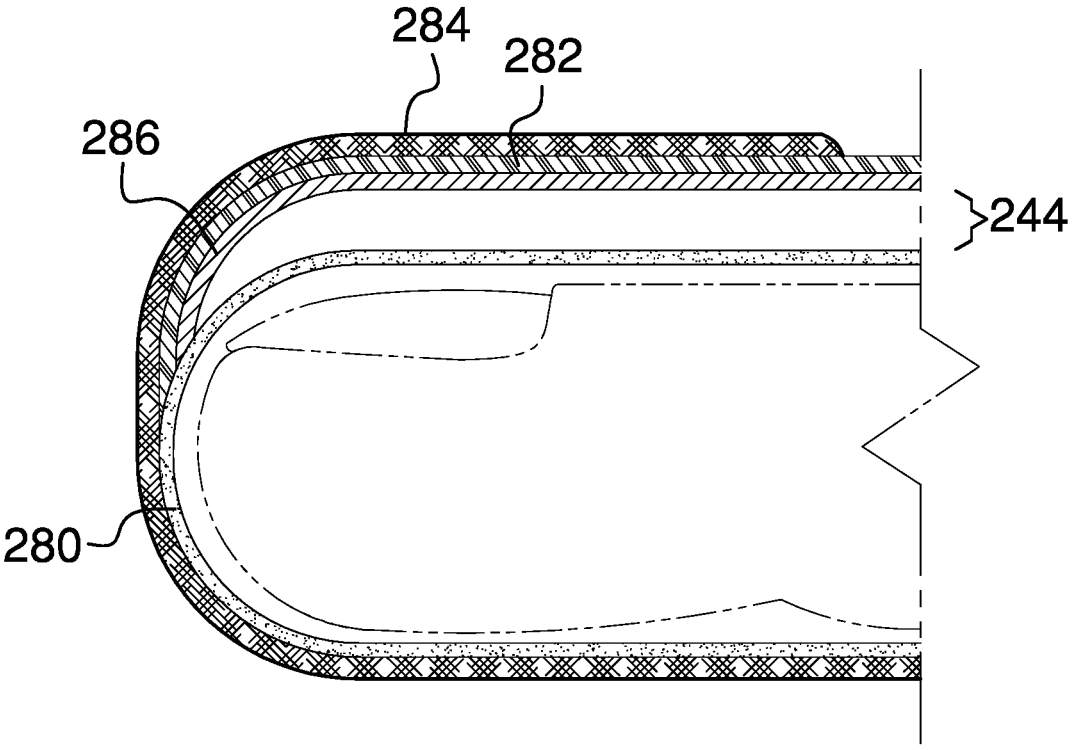
FIG. 6 is a cross-sectional view of an embodiment of the disclosure across 6-6 as shown in FIG. 1.
Figure 7:
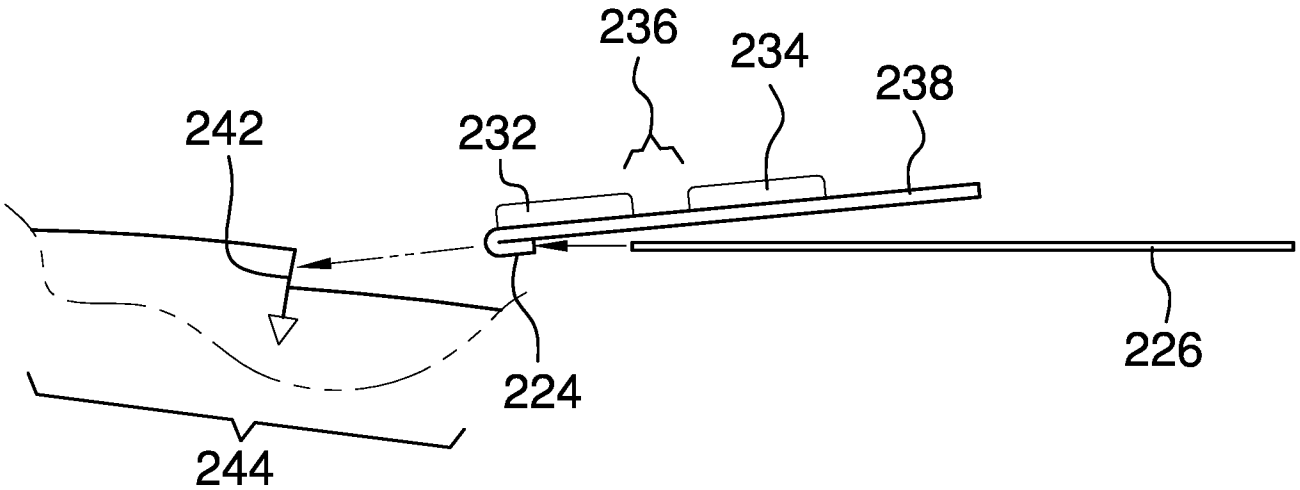
FIG. 7 is a detail view of a second embodiment of the disclosure illustrating insertion of an individual heating strip into an individual heating strip pocket.

Detailed reference will now be made to a first potential embodiment of the disclosure, which is illustrated in FIGS. 1 through 7.

The gloves with finger-warming insert pockets 100 (hereinafter invention) comprises a pair of gloves, a plurality of heating strip pockets 240, and a plurality of heating strips 200. The pair of gloves may be adapted to be donned by a user. The invention 100 may be adapted to warm a user's hands. The plurality of heating strips 200 may be activated to produce heat and may be placed into the plurality of heating strip pockets 240 located on the dorsal side of a plurality of finger stalls 262 on both a left glove and a right glove. The plurality of heating strips 200 may be removed from the plurality of heating strip pockets 240 when spent.

The plurality of heating strip pockets 240 may be pouches located on the dorsal side of each of the plurality of finger stalls 262. The distal end of an individual heating strip pocket 244 selected from the plurality of heating strip pockets 240 may be closed off by a constriction of the material forming the individual heating strip pocket 244. The proximal end of the individual heating strip pocket 244 may be open to form a pocket aperture 242. An individual heating strip 210 selected from the plurality of heating strips 200 may be inserted into and removed from the individual heating strip pocket 244 via the pocket aperture 242. In some embodiments, the pocket aperture 242 may be adapted to be located between a root of the finger and a first knuckle joint.

The plurality of heating strips 200 may be adapted to be placed into the plurality of heating strip pockets 240 where the plurality of heating strips 200 may be located adjacent to fingers. The plurality of heating strips 200 may be adapted to generate heat in order to warm the fingers once the plurality of heating strips 200 have been activated. The individual heating strip 210 may be activated by removing the individual heating strip 210 from a wrapper such that the individual heating strip 210 is exposed to air.

The individual heating strip 210 may comprise a substrate 212 and one or more heating cells 214. The substrate 212 may be an oblong carrier for the one or more heating cells 214 that is sized and shaped to fit within the individual heating strip pocket 244. In some embodiments, the substrate 212 may be made of paper having a grammage of 200 GSM+/−55 GSM.

An individual heating cell selected from the one or more heating cells 214 may comprise a heat generator 220 and an air-permeable covering 222. The heat generator 220 may be a compound that undergoes an exothermic oxidation reaction when activated by exposed to air. The air-permeable covering 222 may surround the heat generator 220 to retain the shape of the individual heating cell. As a non-limiting example, the heat generator 220 may be composed of iron powder, water, an absorbent material such as vermiculite, activated charcoal, salt, or combinations thereof.

In a preferred embodiment, the one or more heating cells 214 may comprise two heating cells. A first heating cell 232 may be located at the distal end of the substrate 212. A second heating cell 234 may be located on the same side of the substrate 212 as the first heating cell 232 with a separation 236 between the first heating cell 232 and the second heating cell 234, leaving a gripping area 238 at the proximal end of the substrate 212.

The individual heating strip 210 may further comprise a cup 224. The cup 224 may be an enlargement of the distal end of the substrate 212 on the side of the substrate 212 that is opposite the one or more heating cells 214. The cup 224 may be shaped to capture an end of a pushing stick 226 such that the pushing stick 226 may be operable to push the individual heating strip 210 into the individual heating strip pocket 244.

The individual heating strip 210 may be packaged in the wrapper until used. The wrapper may be airtight to prevent air from reaching the one or more heating cells 214 so that the one or more heating cells 214 are not activated while in the wrapper.

The pair of gloves may comprise the left glove that is adapted to fit a left hand and the right glove that is adapted to fit a right hand. An individual glove 260 may comprise a trank 266 that is adapted to cover a palm and a back of the hand and the plurality of finger stalls 262 that are adapted to cover the fingers.

In some embodiments, the individual glove 260 may comprise a cuff 268. The cuff 268 may be adapted to cover a sleeve of a garment.

In some embodiments, the pair of gloves may comprise layered fabrics to increase comfort and to improve wear characteristics of the pair of gloves. The layered fabrics may cover the entirety of the pair of gloves or may cover one or more areas of the pair of gloves. As non-limiting examples, the layered fabrics may cover the plurality of finger stalls 262, the tranks 266, the plurality of heating strip pockets 240, the cuffs 268, or combinations thereof.

As a non-limiting example, the individual glove 260 selected from the pair of gloves may comprise a jersey layer 280 as an innermost layer. The jersey layer 280 may be a knitted material made of wool, cotton, or synthetic materials.

As a non-limiting example, the individual glove 260 may comprise a leather layer 284 as an outermost layer of the individual glove 260 on the palm side. The leather layer 284 may be made from natural or synthetic leather, or some other material. The leather layer 284 may reduce heat loss and enhance durability of the individual glove 260.

In some embodiments, the layered fabrics may comprise a poplin layer 286 as an intermediate layer between the jersey layer 280 and the denim layer 282. The poplin layer 286 may be bonded to the denim layer 282 such that the heating strip is inserted between the poplin layer 286 and the jersey layer 282. The poplin layer 286 may be a woven cotton that reduces friction during insertion and removal of the individual heating strip 210.

In use, the user may remove an individual heating strip 210 from the wrapper and may insert the individual heating strip 210 into an individual heating strip pocket 244 on an individual glove 260. The user may push the individual heating strip 210 into the individual heating strip pocket 244 using a pushing stick 226 if necessary. Responsive to exposure to air, the individual heating strip 210 may be activated and may begin to generate heat. The user may repeat the process until a plurality of heating strips 200 have been activated and inserted into a plurality of heating strip pockets 240 on both the left glove and the right glove. The user may then don the pair of gloves and the pair of gloves may warm the user's hands. Once spent, the individual heating strip 210 may be removed from the individual heating strip pocket 244 by pulling on the substrate 212.

The invention 100 has been presented in terms of the pair of gloves, however those skilled in the art will recognize that the inventive elements disclosed herein are equally applicable to gloves that are packaged and/or sold individually.

Definitions

As used in this disclosure, "abrasion" may refer to the rubbing of a first object against a second object in a manner that generates friction.

As used herein, "airtight" may refer to a container or seal that is impermeable to air.

As used in this disclosure, an "aperture" may be an opening in a surface. Aperture may be synonymous with hole, slit, crack, gap, slot, or opening.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "dorsal" may refer to the upper or back side of a human, animal, plant or organ and "ventral" may refer to the lower or front side of the human, animal, plant, or organ. As applied to a hand, "dorsal" may refer to the back of the hand and "palmer" may refer to the palm side of the hand.

As used herein, "grammage" may refer to the area density of a paper product. Grammage is closely related to "basis weight". Grammage may be expressed in grams per square meter (GSM) or in terms of the mass (expressed as weight) for a number of sheets of a specific size of paper. In the U.S., grammage is commonly expressed as the weight of a ream of paper (500 sheets).

As used in this disclosure, a "glove" may be an item of apparel that covers a hand. A glove may comprise five finger stalls into which the fingers of the hand are inserted. A glove may further be defined with a palm side (also called the palmer side) and a back side (also called the dorsal side). The palm side is proximal to the palm of the hand. The back side is distal from the palm side.

As used in this disclosure, "GSM" may be an acronym that stands for grams per square meter. The GSM is a standardized measure of the grammage of paper weight that is defined in ISO 536. The GSM is essentially the weight of an A0 (as defined in ISO 236) size sheet of paper in grams.

As used in this disclosure, the term "intermediate" may refer to a location that lies between a first object and a second object As used herein, "oblong" may refer to an object that is elongated.

As used in this disclosure, a "pocket" may be a pouch or storage space that is formed into an object. Pockets are often formed by joining a second textile or a second sheeting to a first textile or a first sheeting, respectively, by sewing or heat sealing respectively.

As used in this disclosure, the "trank" may refer to the portion of a glove that covers the palm and back of the hand. Trank may refer to the individual covering for the palm and the back of the hand as separate components or may refer to a single component that is folded and sewn to cover both.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. Gloves with finger-warming insert pockets comprising:
- a pair of gloves, a plurality of heating strip pockets, and a plurality of heating strips;
- wherein the pair of gloves are adapted to be donned by a user;
- wherein the gloves with finger-warming insert pockets are adapted to warm a user's hands;
- wherein the plurality of heating strips are activated to produce heat and are placed into the plurality of heating strip pockets located on a dorsal side of a plurality of finger stalls on both a left glove and a right glove;
- wherein the plurality of heating strips are removed from the plurality of heating strip pockets when spent;
- wherein the individual heating strip comprises a substrate and one or more heating cells;
- wherein an individual heating strip of the plurality of heating strips is further defined as a cup;
- wherein the cup is an enlargement of a distal end of a substrate on a side of the substrate that is opposite the one or more heating cells;
- wherein the cup is shaped to capture an end of a pushing stick such that the pushing stick is operable to push the individual heating strip into the individual heating strip pocket.

2. The gloves with finger-warming insert pockets according to claim 1
- wherein the plurality of heating strip pockets are pouches located on the dorsal side of each of the plurality of finger stalls;
- wherein the distal end of an individual heating strip pocket selected from the plurality of heating strip pockets is closed off by a constriction of the material forming the individual heating strip pocket;
- wherein the proximal end of the individual heating strip pocket is open to form a pocket aperture;
- wherein an individual heating strip selected from the plurality of heating strips is inserted into and removed from the individual heating strip pocket via the pocket aperture.

3. The gloves with finger-warming insert pockets according to claim 2
- wherein the pocket aperture is adapted to be located between a root of the finger and a first knuckle joint.

4. The gloves with finger-warming insert pockets according to claim 2
- wherein the plurality of heating strips are adapted to be placed into the plurality of heating strip pockets where the plurality of heating strips are located adjacent to fingers;
- wherein the plurality of heating strips are adapted to generate heat in order to warm the fingers once the plurality of heating strips have been activated.

5. The gloves with finger-warming insert pockets according to claim 4
- wherein the individual heating strip is activated by removing the individual heating strip from a wrapper such that the individual heating strip is exposed to air.

6. The gloves with finger-warming insert pockets according to claim 5
- wherein the substrate is an oblong carrier for the one or more heating cells that is sized and shaped to fit within the individual heating strip pocket.

7. The gloves with finger-warming insert pockets according to claim 6 wherein the substrate is made of paper having a grammage of 200 GSM+/−55 GSM.

8. The gloves with finger-warming insert pockets according to claim 6 wherein an individual heating cell selected from the one or more heating cells comprise a heat generator and an air-permeable covering;

wherein the heat generator is a compound that undergoes an exothermic oxidation reaction when exposed to air;

wherein the air-permeable covering surrounds the heat generator to retain the shape of the individual heating cell.

9. The gloves with finger-warming insert pockets according to claim 8 wherein the heat generator is composed of iron powder, water, an absorbent material, activated charcoal, salt, or combinations thereof.

10. The gloves with finger-warming insert pockets according to claim 9 wherein the one or more heating cells comprise two heating cells;

wherein a first heating cell is located at the distal end of the substrate;

wherein a second heating cell is located on the same side of the substrate as the first heating cell with a separation between the first heating cell and the second heating cell, leaving a gripping area at the proximal end of the substrate.

11. The gloves with finger-warming insert pockets according to claim 10 wherein the individual heating strip is packaged in the wrapper until used;

wherein the wrapper is airtight to prevent air from reaching the one or more heating cells so that the one or more heating cells are not activated while in the wrapper.

12. The gloves with finger-warming insert pockets according to claim 11 wherein the pair of gloves comprise the left glove that is adapted to fit a left hand and the right glove that is adapted to fit a right hand;

wherein an individual glove comprises a trank that is adapted to cover a palm and a back of the hand and the plurality of finger stalls that are adapted to cover the fingers.

13. The gloves with finger-warming insert pockets according to claim 12 wherein the individual glove comprises a cuff;

wherein the cuff is adapted to cover a sleeve of a garment.

14. The gloves with finger-warming insert pockets according to claim 13 wherein the pair of gloves comprise layered fabrics;

wherein the layered fabrics covers the entirety of the pair of gloves or cover one or more areas of the pair of gloves.

15. The gloves with finger-warming insert pockets according to claim 14 wherein the individual glove selected from the pair of gloves comprises a jersey layer as an innermost layer;

wherein the jersey layer is a knitted material made of wool, cotton, or synthetic materials.

16. The gloves with finger-warming insert pockets according to claim 15 wherein the individual glove comprises a denim layer, a protective layer, a leather layer as an outermost layer of the individual glove;

wherein the leather layer is made from natural or synthetic leather;

wherein the leather layer reduces heat loss.

17. The gloves with finger-warming insert pockets according to claim 16 wherein the denim layer is located adjacent the individual heating strip;

wherein the denim layer is a twill weave made of cotton;

wherein the denim layer provides abrasion resistance.

18. The gloves with finger-warming insert pockets according to claim 17 wherein the layered fabrics comprises a poplin layer as an intermediate layer between the jersey layer and the denim layer;

wherein the poplin layer is a woven cotton that reduces friction during insertion and removal of the individual heating strip.

* * * * *